US005084055A

United States Patent [19]

Demeester

[11] Patent Number: 5,084,055

[45] Date of Patent: Jan. 28, 1992

[54] DEPILIATING APPLIANCE

[76] Inventor: Jacques Demeester, 1, rue Péron, F-78290 Croissy sur Seine, France

[21] Appl. No.: 441,939

[22] Filed: Nov. 27, 1989

[30] Foreign Application Priority Data

Dec. 7, 1988 [FR] France ..... 88 16048

[51] Int. Cl.[5] ..... A61B 17/50

[52] U.S. Cl. ..... 606/133; 452/102

[58] Field of Search ..... 606/133; 17/11.1 R, 17/47; 452/71, 82, 83, 102, 84

[56] References Cited

U.S. PATENT DOCUMENTS

| | | | |
|---|---|---|---|
| 2,900,661 | 8/1959 | Schnell | 17/11.1 R |
| 4,079,741 | 3/1978 | Daar et al. | 606/133 |
| 4,575,902 | 3/1986 | Alazet | 19/2 |
| 4,807,624 | 2/1989 | Gross et al. | 17/11.1 R |
| 4,825,867 | 3/1989 | Gross et al. | 17/11.1 R |
| 4,960,422 | 10/1990 | Demeester | 606/135 |

FOREIGN PATENT DOCUMENTS

| | | |
|---|---|---|
| 0147285 | 7/1985 | European Pat. Off. . |
| 788130 | 10/1935 | France . |
| 1017490 | 12/1952 | France . |
| 1140548 | 7/1957 | France . |
| 2334320 | 7/1977 | France . |

*Primary Examiner*—C. Fred Rosenbaum
*Assistant Examiner*—William W. Lewis
*Attorney, Agent, or Firm*—Young & Thompson

[57] ABSTRACT

In order to pluck-out superfluous hairs, a hand-held depilating appliance has a rotary drum which carries one or a number of rows of gripping blades so arranged as to project from the periphery of the drum and to extend in a direction parallel to its axis. Within or opposite to the recesses existing at the periphery of the rotary drum between the different rows of gripping blades, provision is made for skin protection blades having a circular external contour, the center of which coincides with the axis of the drum. These protective blades are disposed in planes perpendicular to the axis of the drum and are distributed over its entire length so as to constitute a virtual protection cylinder at the periphery of the depilating roller formed by the drum and the gripping blades.

10 Claims, 2 Drawing Sheets

FIG. 1
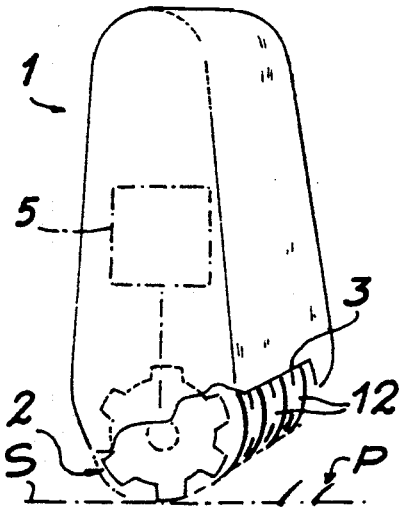
FIG. 3
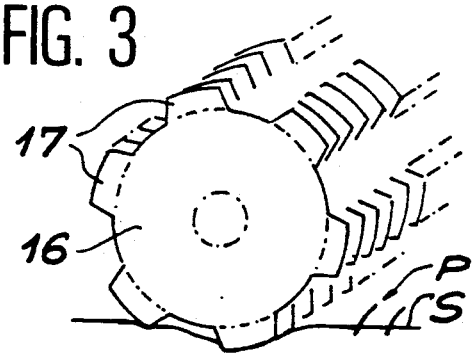
FIG. 2
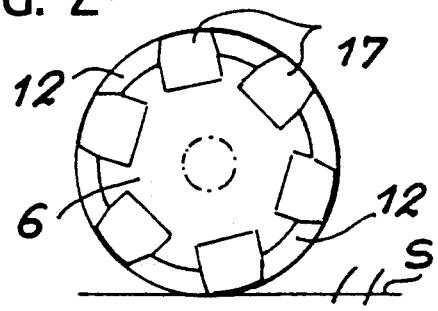
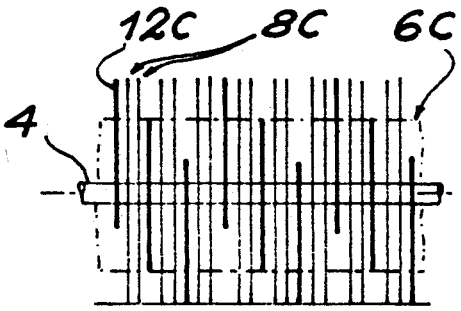
FIG. 9
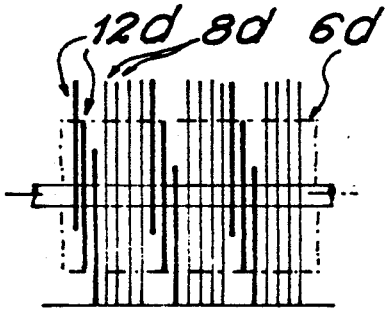
FIG. 10
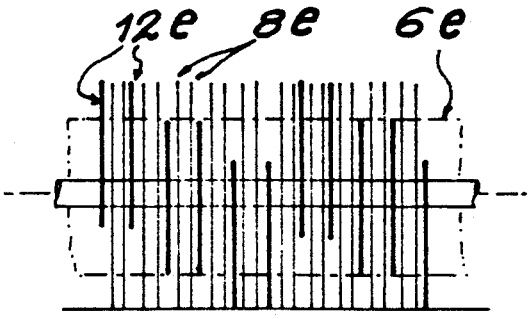
FIG.11

DEPILIATING APPLIANCE

BACKGROUND OF THE INVENTION

1. Field of the Invention

The present invention relates to small depilating appliances which can be held in one hand for the removal of superfluous hairs.

2. Description of the Prior Art

French patent No. 2,334,320 describes an appliance of this type in which a rotating roller is provided for plucking-out the hairs to be removed. This depilating roller is formed by a helical spring, the turns of which are alternately opened-out, then drawn together so that the hairs can engage between said turns when these latter are opened-out in order to be subsequently gripped between them and plucked-out as a result of rotation of the roller about its own axis.

However, this appliance is of limited efficiency. This is essentially due to the fact that the hairs to be removed cannot readily engage between the turns of the rotary spring on account of their helical shape. Moreover, again by reason of the helical shape of the turns, the hairs are displaced by the turns in the transverse direction at the time of rotation of the plucking roller. This in fact has the effect of interfering with the engagement of the ends of the hairs between the turns of the spring.

In an entirely different field, there exist devices for plucking poultry which also have a rotary plucking roller. In one of these devices, a rotary drum carries at its periphery several rows of pairs of jaws which are adapted to open and close alternately in order to permit first of all the engagement of the shafts of the feathers to be plucked-out between these jaws, then gripping of the shafts by the jaws. This roller is placed at a certain distance above a comb which is intended to slide on the surface of the skin of the fowl to be plucked, whereupon the feather shafts engage between the teeth of the comb in order to be subsequently gripped by the jaws of the rotary drum. The comb has the effect of retaining the skin at the time of plucking of the feathers since the plucking operation calls for a relatively high tractive force. At the same time, however, the comb protects the skin of the fowl against any contact with the gripping jaws which are so arranged as to project from the rotary drum. Furthermore, if the comb did not exist, the jaws would strike the skin and cause extremely deep injuries.

Taking into account the fact that the gripping jaws are placed substantially in planes perpendicular to the axis of the rotary drum, engagement of the shafts of the feathers to be plucked takes place under much better conditions than in the case of hairs to be removed by the depilating appliance mentioned earlier. However, for depilation of superfluous hairs existing on a person's skin, it is not possible to employ a device similar to the plucking device mentioned above, this being so for a certain number of reasons. The first reason lies in the fact that the comb provided beneath the rotary drum would have to be eliminated since it produces an excessive spacing of said drum with respect to the skin, with the result that it would not be possible to grip hairs which are much shorter than feather shafts. However, if the comb were suppressed, the skin would in that case have no protection against the gripping jaws carried by the rotary drum. Since said jaws project from the periphery of said drum, they would consequently strike the skin and, as mentioned earlier, would result in extremely deep injuries.

It is for the reasons stated in the foregoing that the invention is directed to a depilating appliance which is designed both in order to obtain efficient engagement and gripping of hairs between the plucking elements and in order to ensure complete protection of the skin against any risk of injuries which would be caused by the plucking elements as they move against the skin.

SUMMARY OF THE INVENTION

In order to pluck-out hairs to be removed, the appliance in accordance with the invention comprises a rotary drum adapted to carry one or a number of rows of gripping elements so arranged as to project from the periphery of said drum and to extend in a direction parallel to the axis of this latter. However, the distinctive feature of said appliance lies in the fact that, within or opposite to the recesses existing at the periphery of the rotary drum between the different rows of gripping elements, provision is made for skin protection blades having a circular external contour, the center of which coincides with the axis of the rotary drum. Said blades can form disks having a continuous circular contour or portions of disks angularly displaced with respect to each other so as to constitute a virtual cylinder at the surface of the rotary roller formed by the complete assembly.

Thus the present appliance makes it possible to obtain excellent protection of the skin against any danger of injury while offering maximum efficiency of gripping of hairs between the gripping elements carried by the rotary drum.

BRIEF DESCRIPTION OF THE DRAWINGS

FIG. 1 is a schematic view in perspective of a depilating appliance in accordance with the invention.

FIG. 2 is a schematic transverse sectional view of the depilating roller provided in this appliance.

FIG. 3 is a similar view which illustrates the work conditions of a similar roller which would not be provided with the protective blades existing in said roller.

FIGS. 9 to 11 are schematic views in axial cross-section illustrating different alternative embodiments of the depilating roller.

DESCRIPTION OF THE PREFERRED EMBODIMENTS

The appliance illustrated in FIGS. 1 to 6 comprises a small casing 1 which is intended to be held in one hand. Said casing is adapted to carry at one end a rotary depilating roller designated by the general reference 2. Said roller projects through an opening 3 formed in the corresponding end of the casing. Thus said roller can be displaced in contact with a person's skin S in order to pluck-out superfluous hairs P of the skin.

Figure 4:
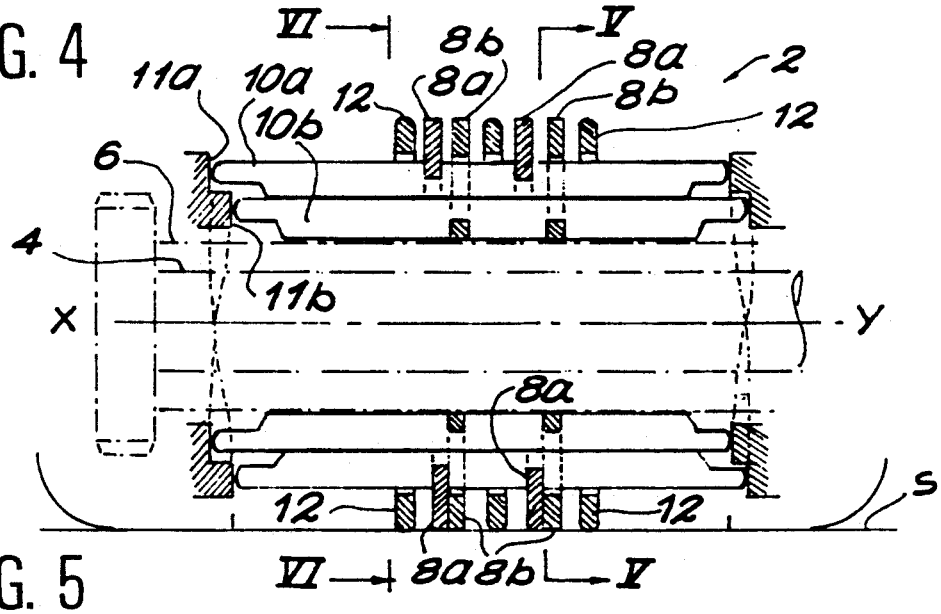
FIG. 4 is a schematic axial sectional view of the depilating roller provided in the present appliance.
Figure 5:
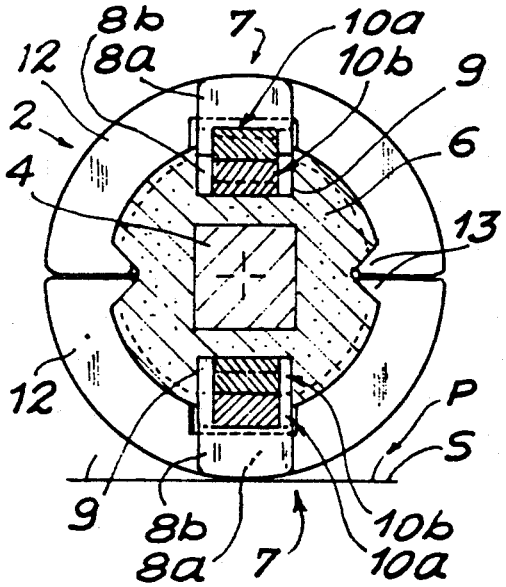
FIGS. 5 and 6 are views in transverse cross-section taken respectively along lines V—V and VI—VI of FIG. 4.
Figure 6:
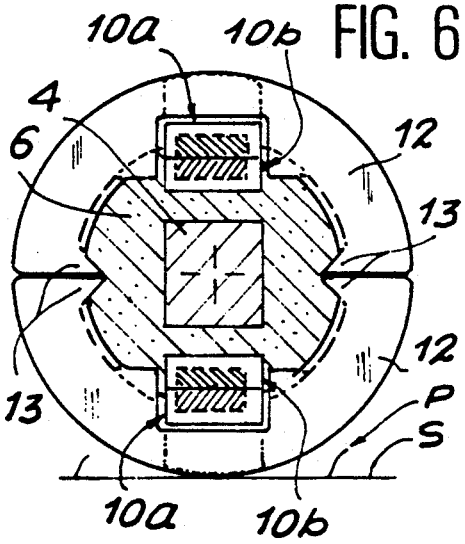

Said depilating roller comprises a drum 6 carried by a rotary shaft 4 driven in rotation by a small electric motor 5 housed within the casing 1. Said drum carries several rows of gripping jaws which project from its periphery and extend in a direction parallel to the axis of said drum. In order to simplify the drawings, FIGS. 4 to 6 show only two rows 7 of jaws of this type. These jaws consist of flat blades 8*a* and 8*b* of metal or any other suitable material which are disposed in planes at right angles to the axis of the drum 6 while being displaced with respect to each other in the axial direction. These gripping blades are fixed at their lower ends by snap-action engagement or other means on two separate and distinct actuating bars 10*a* and 10*b*. Said gripping blades are grouped together in pairs of blades 8*a* and 8*b* which are intended to be applied periodically against each other. All the blades 8*a* are fixed on the same actuating bar 10*a* whilst all the blades 8*b* are fixed on the other bar 10*b*. The ends of said bars are placed opposite to stationary cams 11*a* and 11*b* which are intended to actuate them so as to produce the gripping action of the blades 8*a*–8*b* and the separation of these latter in alternate sequence during rotation of the depilating roller.

In accordance with the essential feature of the appliance contemplated by the invention, said roller has a series of protective blades which are intended to guard against any danger of contact of the gripping jaws with the skin and consequently against any danger of injury of the skin. These protective blades are so arranged as to form a virtual cylinder at the surface of the rotary depilating roller formed by the drum 6 and the gripping jaws, the cross-section of said cylinder being such as to correspond to the circle circumscribed about the gripping jaws 8*a* and 8*b*. These jaws can advantageously be provided with a circular external contour having the same curvature, at least to a partial extent, so as to be flush with the surface of the virtual cylinder thus formed. However, the external edge of said jaws can also be slightly set back with respect to the surface of this virtual cylinder.

In the example shown in FIGS. 1 to 6, provision is made for a series of protective blades 12 each assuming the shape of a flat washer having a circular external contour corresponding to the curvature of the protective virtual cylinder to be formed. These protective blades are grouped together in pairs while being arranged in opposite directions as shown in FIGS. 5 and 6, thus virtually constituting a disk having a continuous external contour which is placed in a plane perpendicular to the axis X–Y of the depilating roller. Said protective blades are fixed on the periphery of the drum 6 by means of spurs 13 or the like which are engaged in recesses formed at the periphery of said drum.

The different pairs of protective blades 12 are displaced in the axial direction with respect to the position of the gripping blades 8*a* and 8*b*. As shown in FIG. 4, provision can be made for a pair of said protective blades between two successive pairs of gripping jaws 8*a* and 8*b*. The disks constituted by the blades 12 are so arranged as to be located opposite to the recesses existing between the two rows 7 of gripping jaws 8*a*, 8*b*. Blades of this type are provided along the entire length of the depilating roller and form around this latter a virtual cylinder which is intended to be placed in contact with the skin and to prevent the skin from penetrating into the depilating roller. This accordingly guards against any danger of pinching or injury of the skin by the gripping blades 8*a* and 8*b* while they are rotating.

The efficiency of this protection is in any case very clearly brought out by FIGS. 5 and 6 as well as by FIGS. 2 and 3. As is apparent from FIGS. 5 and 6, the depilating roller can be placed in direct contact with the skin S without any danger. In such a case, the protective blades 12 come into contact with the skin and consequently prevent this latter from engaging in the recesses which exist on the periphery of the drum 6 between two successive rows 7 of gripping jaws 8*a* and 8*b*. In point of fact, if such protective blades 12 did not exist, the situation would thus be as illustrated in FIG. 3, in which the depilating roller would be constituted by a rotary drum 16 provided with several rows 17 of gripping jaws so arranged as to project from its periphery. In such a case, these projecting jaws would in fact strike the skin and form gashes. On the other hand, such a situation cannot arise in the case of the depilating roller of the appliance in accordance with the invention. In fact, even if this roller is provided with a large number of rows 17 of gripping jaws, as is the case in the example illustrated in FIG. 2, protection of the skin is ensured by the blades 12 described earlier. By reason of this perfect protection, it is possible to dispense with any grid or other intermediate protection element. Thus the gripping jaws can be placed in immediate proximity to the skin, thereby achieving enhanced efficiency of the appliance under consideration.

The protection provided by the blades 12 guards against any risk of pinching of beauty spots, moles or fine skin with the attendant danger of pulling-away of the skin. These blades 12 also have the advantage of protecting the skin against the impact of the gripping jaws during rotation of the complete assembly. It is in fact of primary importance to prevent the skin from being injured, pinched or even simply irritated as the gripping jaws pass at high speed while the user is pressing the appliance against the skin for greater efficiency.

Taking into account the axial displacement of their position with respect to the position of the gripping jaws, the protective blades 12 allow an empty space to remain between two successive rows 7 of jaws. Thus the hairs P which are virtually combed by the protective blades 12 are brought into position within the free spaces existing between two successive rows 7 of gripping jaws. In consequence, these hairs engage very readily between said jaws so as to be subsequently gripped, then plucked-out. This accordingly ensures very high efficiency of the present appliance.

In regard to engagement of hairs between the gripping blades, it should be observed that this operation is considerably facilitated when the protective blades are constituted by disks having recesses or else by circular sectors in spaced relation. In fact, the existence of recesses or intervals at the periphery of the virtual protection roller prevents the application of this latter against the skin from having the sole effect of applying hairs against the skin as would be the case with a roller constituted by circular disks having no discontinuity at their periphery. In the present case, the hairs can stand up again at the moment of passing of a discontinuity of the periphery of the roller and are then combed by the protective blades, thus ensuring their orientation in the desired direction for gripping by the gripping blades.

The protective blades provided in the depilating roller of the present appliance can be arranged in many other ways on condition that said blades are distributed in sufficient number over the entire length of the depilating roller and over its entire periphery through an angle of 360°.

Figure 7:
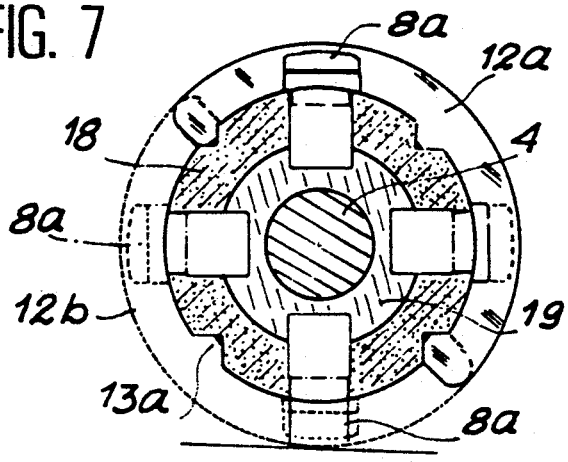
FIG. 7 is a view which is similar to FIG. 5 but which illustrates another embodiment of the depilating roller.
Figure 8:
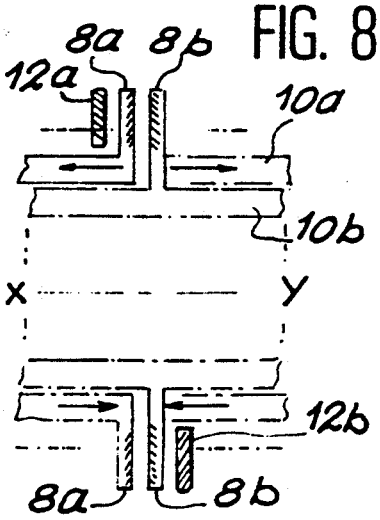
FIG. 8 is a corresponding partial view in axial cross-section.

Thus FIGS. 7 and 8 illustrate an embodiment in which provision is also made for a succession of protective blades 12*a* and 12*b* in the form of arches or of circular half-washers. However, these blades are not distributed in pairs of blades placed opposite to each other in order to constitute a complete circular disk as was the case in the previous example. In fact, in the embodiment shown in FIGS. 7 and 8, the opposite blades 12*a* and 12*b* are relatively displaced in the axial direction. Nevertheless, taking into account the number of these blades over the entire length of the depilating roller, a virtual protection cylinder is obtained as before.

In the embodiment shown in FIGS. 7 and 8, the arrangement of the depilating roller presents a certain number of other differences. Thus the protective blades 12*a* and 12*b* are fixed by means of spurs 13*a* or the like on an intermediate sleeve 18 surrounding a drum 19 which carries the gripping jaws 8*a* and 8*b* and the jaw-actuating bars 10*a* and 10*b*. Moreover, the number of rows of gripping jaws is greater in this case than before. Once again, however, the number of these rows and the arrangement of the protective blades could be different.

Thus, instead of assuming the shape of circular half-washers or of arches, the protective blades could assume the shape of circular sectors. However, these blades could also be constituted by circular segments in spaced relation but angularly displaced from one to the other so as to constitute a virtual protection cylinder around the gripping jaws.

If so required, said circular segments could be disposed in the median plane of the gripping jaws of one and the same pair so as to fill at least to a partial extent the space existing between the different rows 7 of gripping jaws. In such a case there would therefore not be an axial displacement of the protective blades with respect to the gripping jaws.

FIGS. 9 to 11 illustrate very diagrammatically a number of further possibilities of arrangement of protective blades 12*b*, 12*c* and 12*d* between the gripping jaws 8*b*, 8*c* and 8*d* respectively. In the examples thus illustrated, the protective blades are constituted by circular segments which occupy only part of the circumference of the depilating roller. However, these segments are displaced both in the axial direction and in the angular direction so as to constitute a virtual protection cylinder at the periphery of the depilating roller.

In these various examples, the protective blades are coupled for rotation with the drum 6*b*, 6*c* or 6*a* which carries the gripping jaws. However, it would also be possible to provide protective blades which have a fixed position and which would in that case be held by a stationary support on condition, of course, that the arrangement permits rotation of the depilating roller and the clamping and opening movements of the gripping jaws. If so required, the entire assembly of protective blades could be rigidly fixed to a support mounted so as to be capable of translational motion in a direction parallel to the axis of rotation of the drum which carries the gripping blades. Said movable support would then be driven in movements of translation in one direction and in the other so as to enable the protective blades to sweep the space in which the skin would be liable to engage between the gripping blades. A protective assembly of this type could also be freely mounted in translational motion while being subjected to the action of one or a number of springs for holding in position.

If necessary, certain protective blades or all of these blades could be replaced by linear arrays of semi-rigid fingers located in planes perpendicular to the axis of rotation of the drum which carries the gripping blades.

So far as the gripping blades are concerned, they can be arranged differently. In fact, instead of being fixed on their actuating bar 10*a*, 10*b* by snap-action engagement or other means, the lower portions of said jaws could be pivotally mounted on the drum 6 which serves as a support for these latter, in which case the actuating bars 10*a* and 10*b* are coupled with said jaws so as to tilt them in one direction and in the other respectively in order to clamp together or separate their gripping ends.

Moreover, instead of providing gripping jaws constituted by pairs of blades disposed in several rows at the periphery of a rotary drum, it would be possible to construct these jaws in the form of disks provided at their periphery with a series of projecting lugs forming a corresponding number of gripping jaws. Suitable actuating means would in that case be provided for alternately tilting said disks in each direction so as to cause clamping or separation of their different gripping jaws. As in all the preceding cases, however, provision would also be made for protective blade having a circular external contour and occupying the spaces existing between the different gripping jaws in order to constitute a virtual cylinder for protection of the skin, thus guarding against any danger of pinching or injury.

If so required, at least a certain number of protective blades provided in the depilating roller can take part in the process of gripping hairs to be plucked-out. In this case, these blades are associated with strips placed between them and capable of moving in the direction of the axis of the roller in order to clamp the hairs against the corresponding blades.

What is claimed is:

1. A depilating appliance comprising, for plucking-out hairs to be removed from the human body, a casing adapted to be held in one hand and containing a depilating roller formed by a rotary drum carrying a plurality of rows of gripping elements extending in a direction parallel to the axis of said drum and so arranged as to project at regular intervals from the periphery of the drum, thereby forming recesses between two successive rows, a plurality of skin protection blades having a circular external contour at least to a partial extent, the center of which coincides with the axis of the rotary drum, said blades being rotatably driven by said rotary drum and disposed in planes perpendicular to the axis of the rotary drum and distributed over the entire length of said drum, each two immediately adjacent said protection blades being arranged on opposite sides of at least one pair of coacting gripping elements so as to face the recesses between the different rows of gripping elements, thereby constituting a protection means whose periphery lies on a virtual cylinder at the periphery of the depilating roller.

2. A depilating appliance according to claim 1, wherein the protective blades are constituted by flat half-washers grouped together in pairs while being located opposite to each other so as to form disks having a continuous external contour, the positions of said disks being displaced in the axial direction with respect to the gripping jaws so as t ensure that each disk is placed between two successive jaws of one and the same row.

3. A depilating appliance according to claim 1, wherein the protective blades are constituted by portions of disks in angularly displaced relation relative to each other and located in planes which are displaced with respect to the gripping jaws of the different rows, said portions of disks being distributed both over the entire length of the depilating roller and over its entire periphery.

4. A depilating appliance according to claim 1, wherein the protective blades are constituted by circular segments each located in a median plane of a pair of gripping jaws and each segment aforesaid occupies at least part of the interval existing from one row of gripping jaws to the next row on the rotary drum.

5. A depilating appliance according to claim 1, there being a housing from which portions of said gripping elements and said blades protrude, wherein the protective blades are constituted by circular segments fixed by means of a support which is stationary relative to said housing and displaced in the axial direction with respect to the gripping jaws carried by the rotary drum.

6. A depilating appliance according to claim 1, wherein the gripping jaws are constituted by lugs projecting from the periphery of parallel disks which form the rotary drum of the depilating roller.

7. A depilating appliance according to claim 1, wherein at least a certain number of protective blade take part in the process of gripping hairs to be plucked-out, said blades being associated with strips placed between them and capable of moving in the direction of the axis of the roller so as to clamp the hairs against the corresponding blades.

8. A depilating appliance according to claim 1, wherein the protective blades are provided at their periphery with recesses or discontinuities which are intended to facilitate combing of the hairs to be gripped.

9. A depilating appliance according to claim 1, wherein the protective blades are rigidly fixed to a support which is capable of displacement in translational motion in a direction parallel to the axis of rotation of the drum which carries the gripping jaws and the arrangement is such that said movable support is driven in movements of translation in one direction and in the other, thereby enabling the protective blades to sweep the space existing between a certain number of gripping blades.

10. A depilating appliance according to claim 1, wherein a certain number of protective blades or all of said blades are replaced by linear arrays of semi-rigid fingers disposed in planes perpendicular to the axis of rotation of the drum which carries the gripping blades.

* * * * *